US006626806B2

(12) United States Patent
Stevens

(10) Patent No.: US 6,626,806 B2
(45) Date of Patent: Sep. 30, 2003

(54) ADJUSTABLE DAMPING ASSEMBLY FOR AN EXERCISING DEVICE

(75) Inventor: Kerry Peter Stevens, Auckland (NZ)

(73) Assignee: Pro Gym Co. International Limited, Tortola (VG)

( * ) Notice: Subject to any disclaimer, the term of this patent is extended or adjusted under 35 U.S.C. 154(b) by 75 days.

(21) Appl. No.: 09/828,418

(22) Filed: Apr. 9, 2001

(65) Prior Publication Data

US 2002/0147076 A1 Oct. 10, 2002

(51) Int. Cl.[7] ..... A63B 21/12
(52) U.S. Cl. ..... 482/114; 482/115; 482/52
(58) Field of Search ..... 482/126, 128, 482/114, 115, 118, 52, 116, 119, 51

(56) References Cited

U.S. PATENT DOCUMENTS 4,374,588 A * 2/1983 Ruggles ..... 482/114
5,536,223 A * 7/1996 Ferber ..... 482/46
5,833,575 A * 11/1998 Holslag ..... 482/51
6,139,476 A * 10/2000 Gallant ..... 482/114

* cited by examiner

*Primary Examiner*—Jerome Donnelly
(74) *Attorney, Agent, or Firm*—Charles E. Baxley

(57) ABSTRACT

A damping assembly for an exercising device includes a shaft with a base member and a rotatable member respectively mounted thereto. The base member has a first annular surface and the rotatable member has a second annular surface which is engaged with the first annular surface with a friction member clamped therebetween. A driving member is connected to the rotatable member and is connected to a power transferring member. An adjustable member is movably mounted to the shaft and a bearing is mounted to the shaft and located between the adjustable member and the rotatable member. The friction between the rotatable member and the base member can be adjustable by moving the adjustable member to compress the rotatable member toward the base member.

2 Claims, 8 Drawing Sheets

ADJUSTABLE DAMPING ASSEMBLY FOR AN EXERCISING DEVICE

FIELD OF THE INVENTION

The present invention relates to a damping assembly for an exerciser wherein the rotatable member is rotatable on a friction member and a lever is operated to compress the rotatable member on the friction member.

BACKGROUND OF THE INVENTION

A conventional exerciser generally has a damping device and the users are required to overcome the damping force between the crank or the like and the damping device. The most frequently used damping device is cylinders which have a piston movable received in a casing and when the user pushes the piston rod into the cylinder, liquid or air in the cylinder resists the piston so as to generate an opposite force to the user's action. By the opposite reaction force, the user obtain the advantages of taking exercise. This type of cylinder can only provide a fixed force so that it cannot meet the requirements of different users who prefer to have a cylinder that the resistant force can be adjustable. Nevertheless, the variable resistant force cylinders are expensive that may not fit the commercial purposes.

The present invention intends to provide a damping assembly that has simple structure and easily to be used.

SUMMARY OF THE INVENTION

In accordance with one aspect of the present invention, there is provided a damping assembly for an exerciser and comprising a shaft with a base member mounted thereto and the base member having a first annular surface. A rotatable member is movably mounted to the shaft and has a second annular surface which is engaged with the first annular surface of the base member. A driving member is connected to the rotatable member and a power transferring member reeves the driving member. An adjustable member is movably mounted to the shaft and a lever extends from the adjustable member. A bearing is mounted to the shaft and located between the adjustable member and the rotatable member.

The primary object of the present invention is to provide a damping assembly that presses a rotatable member toward a base member so as to adjust the friction force between the rotatable member and the base member.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
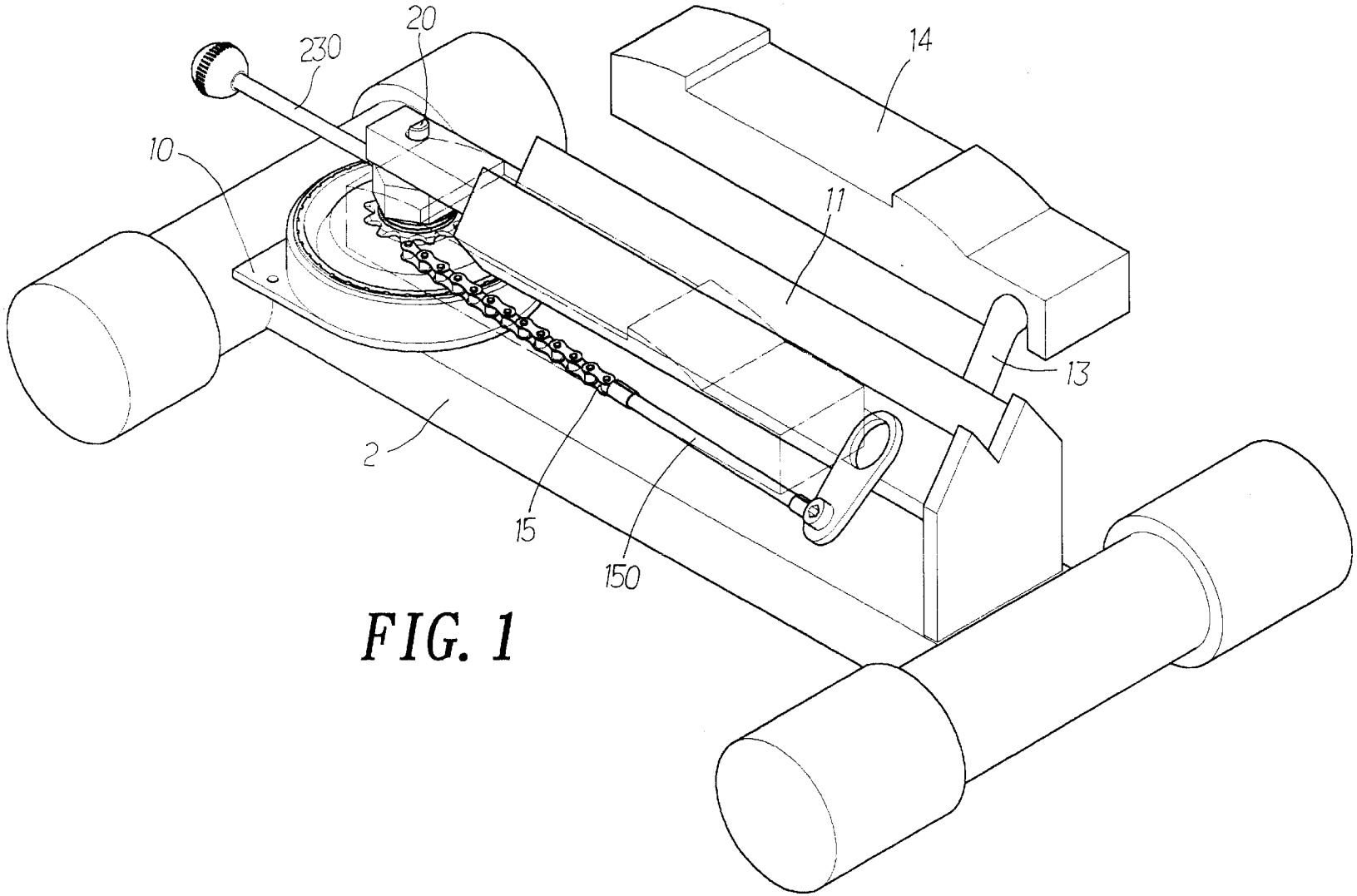
FIG. 1 is a perspective view, partly removed, to show the damping assembly of the present invention on an exercising device.
Figure 2:
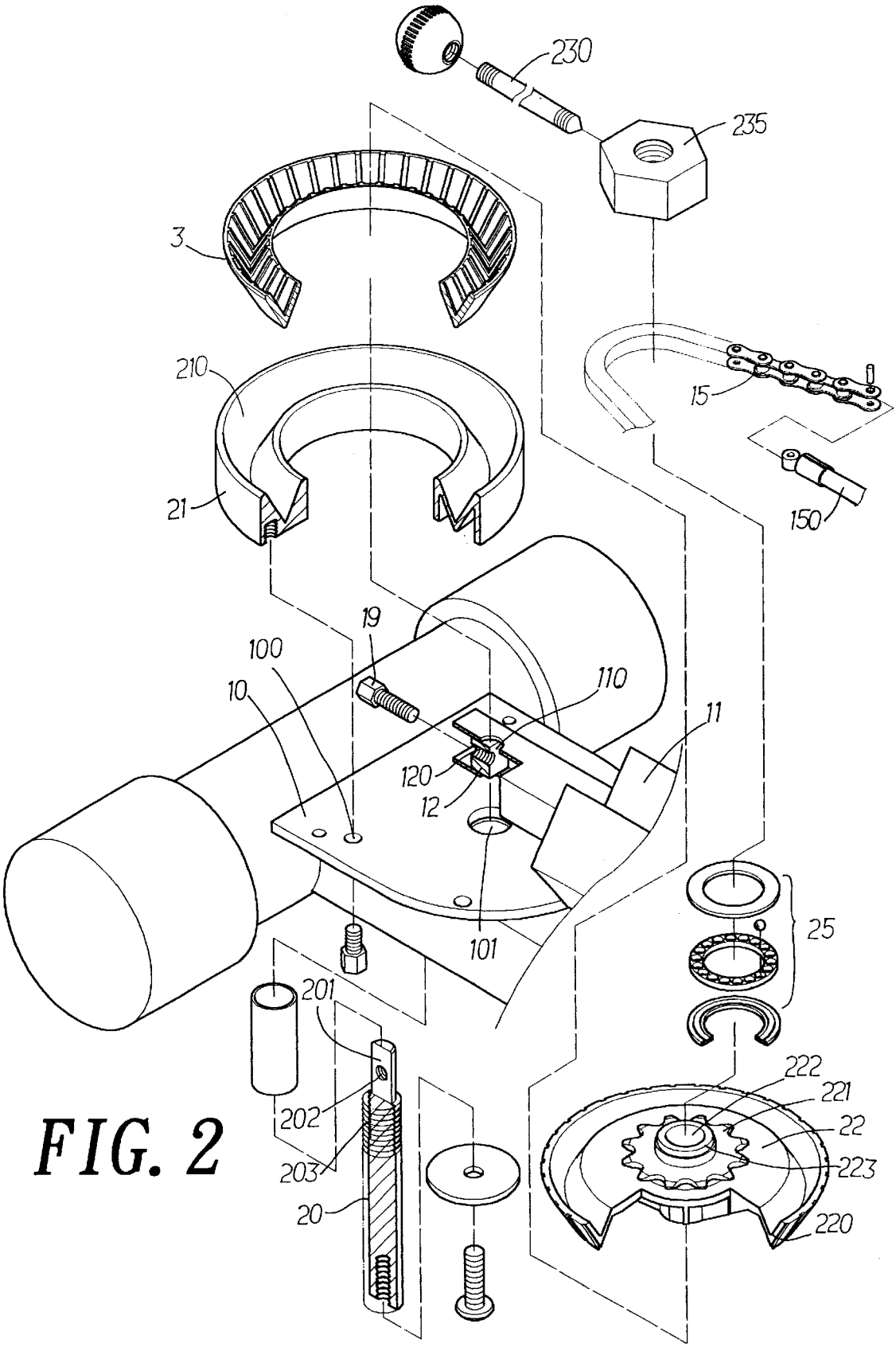
FIG. 2 is an exploded view to show the damping assembly of the present invention.
Figure 3:
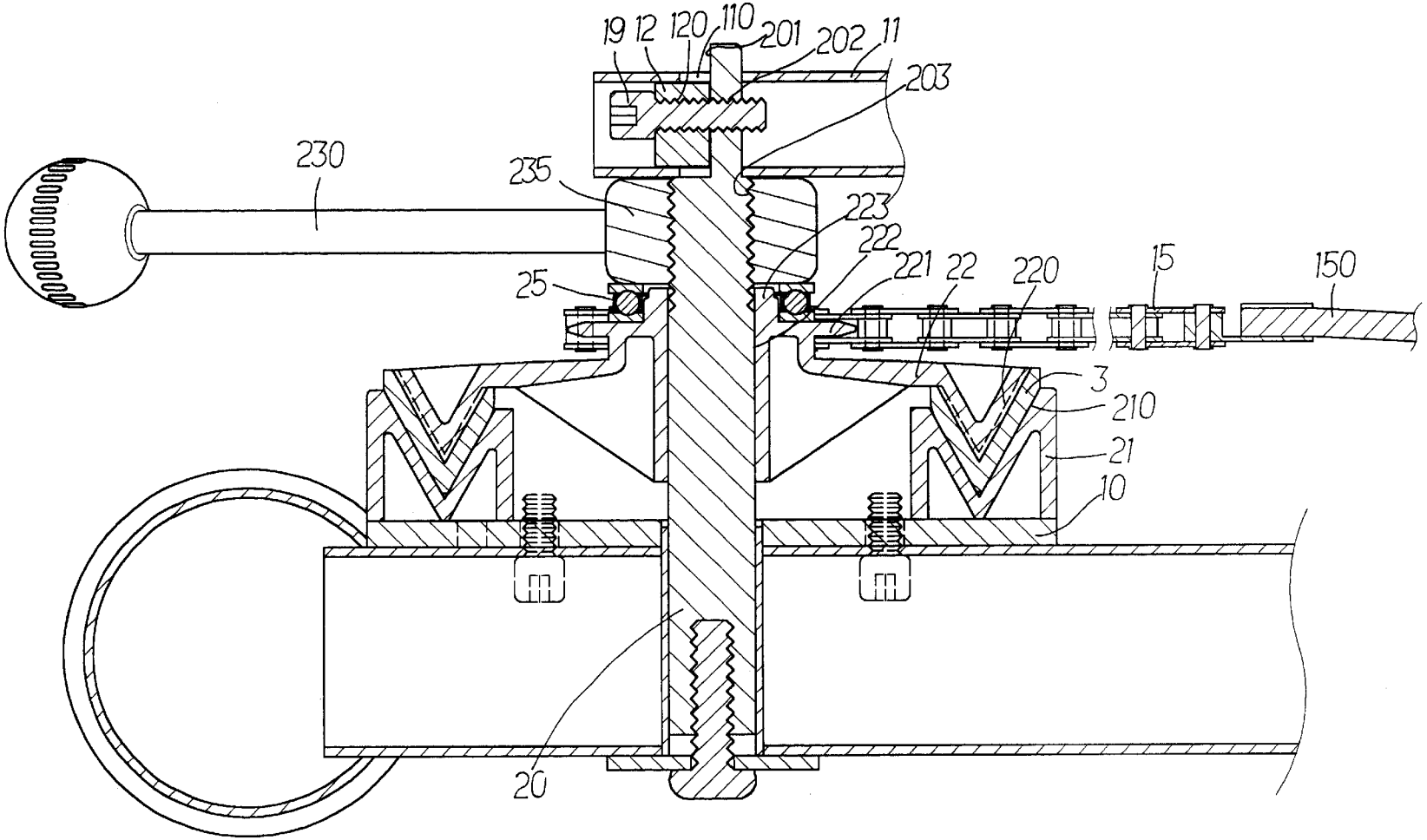
FIG. 3 is a cross sectional view to show the damping assembly of the present invention on an exercising device.

Referring to FIGS. 1 to 3, the damping assembly for an exercising device comprises a frame 2 having two supporting bars and a support board 10 connected between the two supporting bars. A shaft 20 extends through a hole 101 in the board 10 and has a threaded section 203. A surface 201 defined in a top end of the shaft 20 and the top end extends in a hole 110 defined in a top beam 11 located above the board 10. A block 12 is received in the top beam 11 and has a threaded hole 120 and a bolt 19 extends through the threaded hole 120 and a hole 202 in the top end of the shaft 20. The surface 201 contacts the block 12 so that the shaft 20 is not rotatable. A base member 21 is fixedly connected on the board 10 by extending bolts through holes 100 in the board 10 and engaged with threaded recesses in an underside of the base member 21. The base member 21 has a V-shaped first annular surface 210.

A rotatable member 22 has a central tube 223 through which a passage 222 is defined. The shaft 20 extends through the passage 222 and the rotatable member 22 has a V-shaped second annular surface 220 which is engaged with the first annular surface 210 of the base member 21 with a friction member 3 clamped between the first annular surface 210 and the second annular surface 220. The friction member 3 can be made of Teflon, Nylon 66, or MS2 so as to have a durable and high frictional coefficient feature. A driving member such as a gear 221 is connected to the tube 223 of the rotatable member 22 and a power transferring member such as a chain 15 reeves the gear 221. Two ends of the chain 15 are connected to two links 150 and the two links 150 are connected with two cranks 13. Two pedals 14 are connected to the two cranks 13 so that when a user steps on the two pedals 14 and rotates the cranks 13, the chain 15 makes the rotatable member 22 overcome the friction between the friction member 3 and the V-shaped second annular surface 220 and rotates.

An adjustable member 235 is threadedly mounted to the threaded section 203 of the shaft 20 which extends through the base member 21and the friction member 3. A lever 230 extends from the adjustable member 235 and a bearing 25 is mounted to the tube 223 of the rotatable member 220 and contacts the adjustable member 235.

Figure 4:
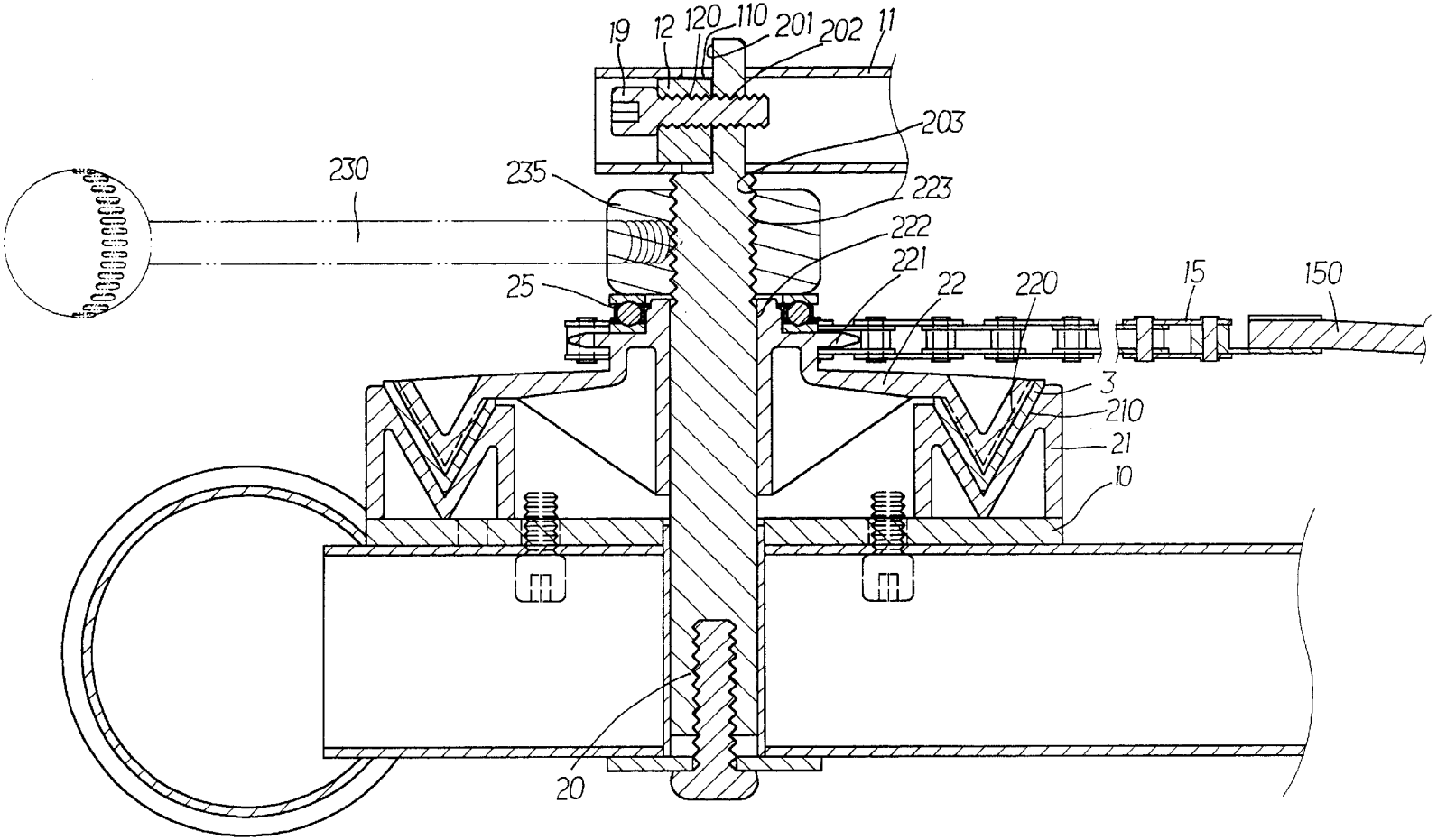
FIG. 4 is a cross sectional view to show adjustable member is lowered to increase the friction force of the damping assembly of the present invention.
Figure 5:
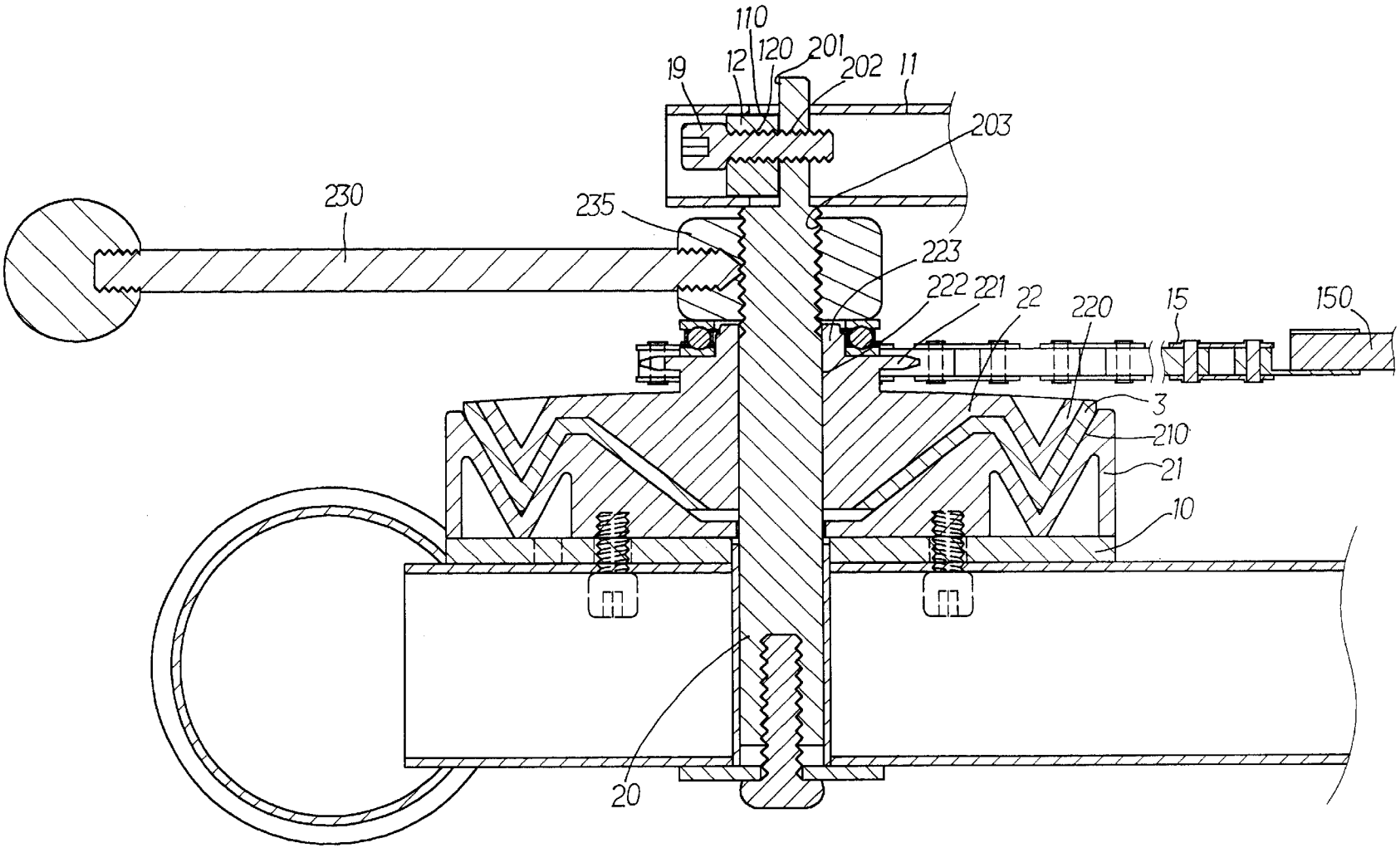
FIG. 5 is a cross sectional view to show another embodiment of the rotatable member of the damping assembly of the present invention.

As shown in FIG. 4, when the user pivots the lever 230 to lower the adjustable member 235, the rotatable member 22 is compressed toward the friction member 3 so that the friction force between the friction member 3 and the V-shaped second annular surface 220 is increased. FIG. 5 shows that the rotatable member 22 and the base member 21 both have a passage and the shaft 20 extends through the passages.

Figure 6:
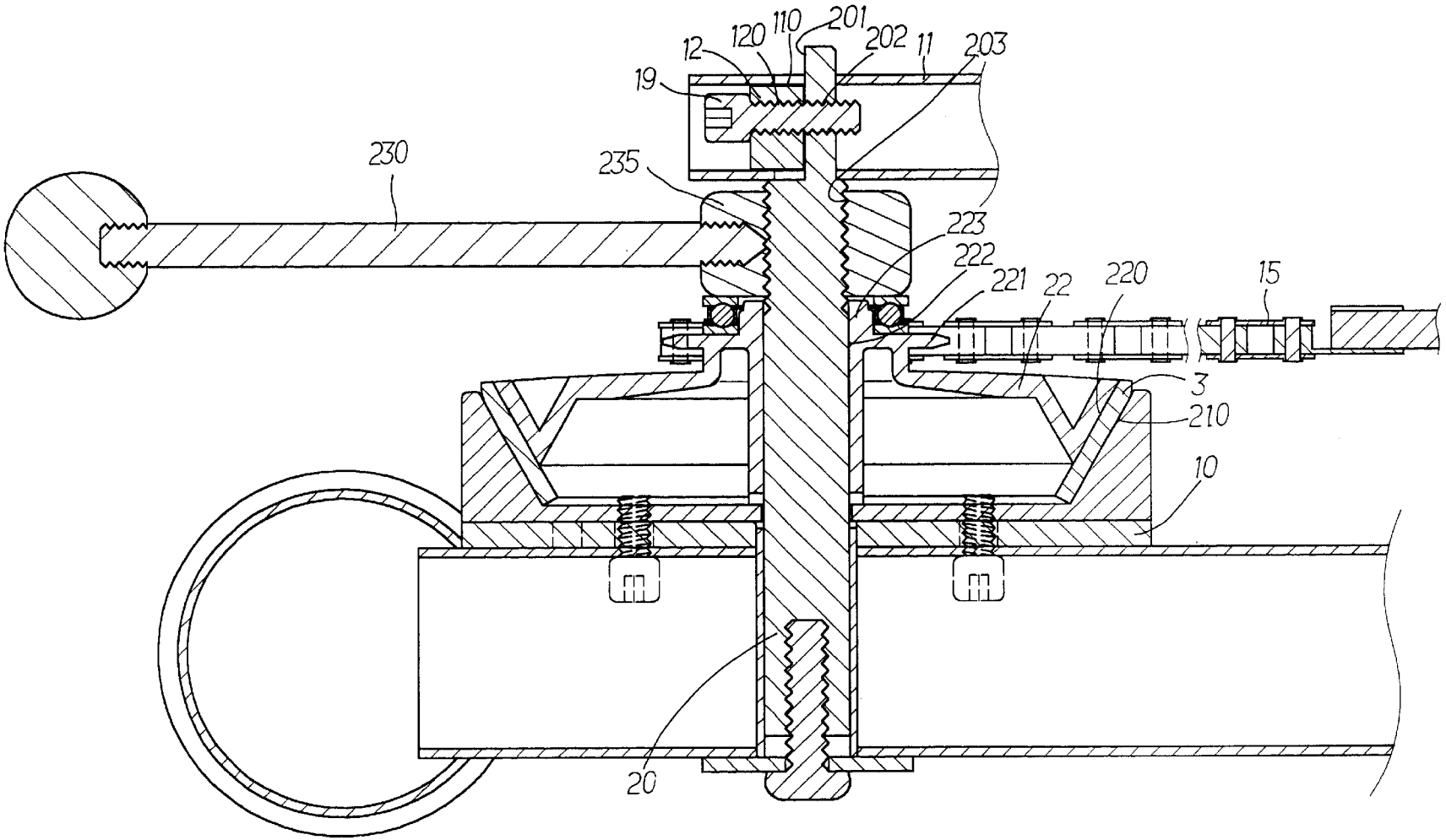
FIG. 6 is a cross sectional view to show yet another embodiment of the rotatable member of the damping assembly of the present invention.

FIG. 6 shows that the first annular surface 210 of the base member 21 is an annular inclined surface and the friction member 3 is a ring member to engage with the first annular surface 210. The second annular surface 220 is engaged with the friction member 3 as shown.

Figure 7:
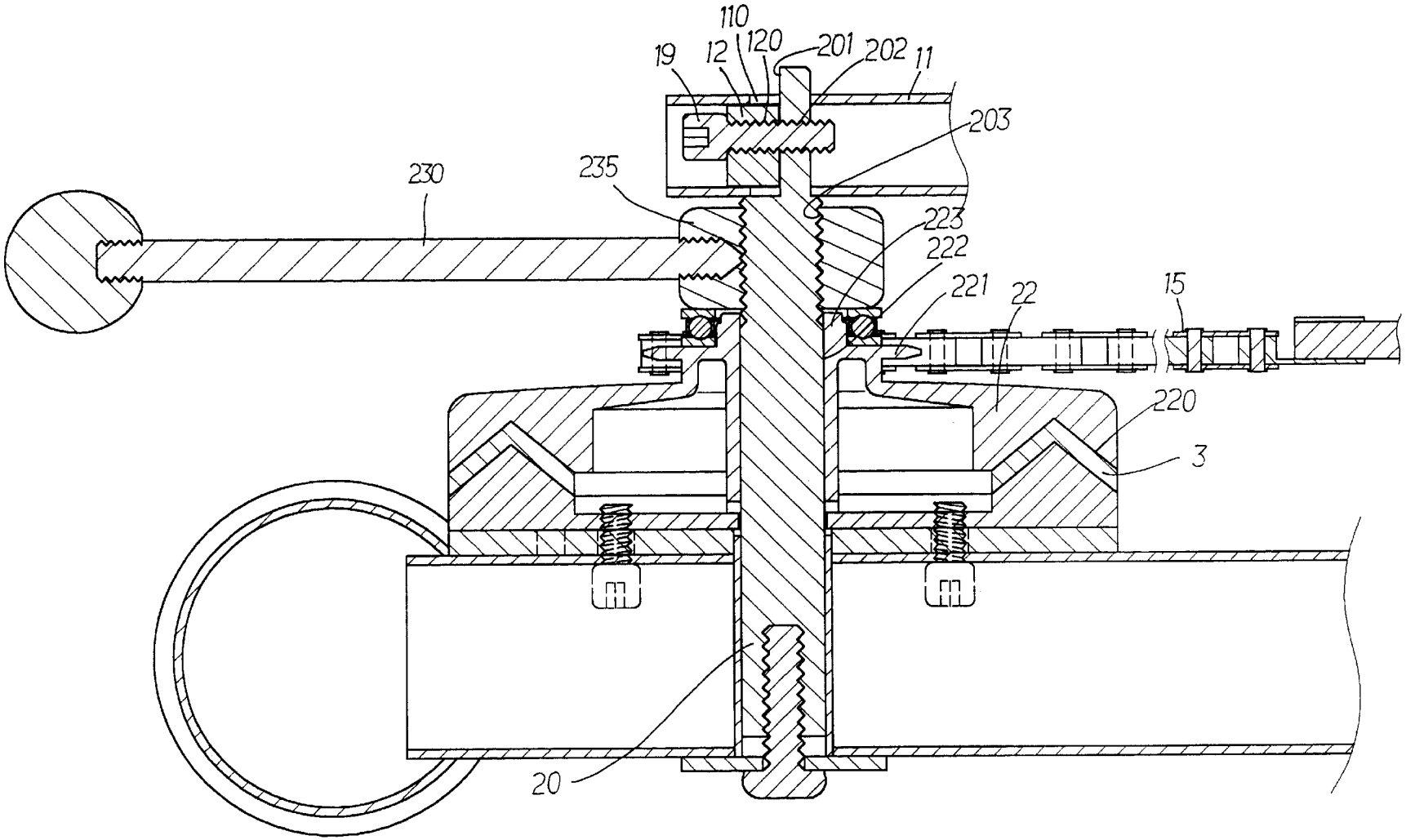
FIG. 7 is a cross sectional view to show a further embodiment of the rotatable member of the damping assembly of the present invention.

FIG. 7 shows that the first annular surface 210 of the base member 21 is an inverted V-shaped surface and the friction member 3 complies with the inverted V-shaped surface. The second annular surface 220 is also an inverted V-shaped surface so as to be engaged with the friction member 3 as shown.

Figure 8:
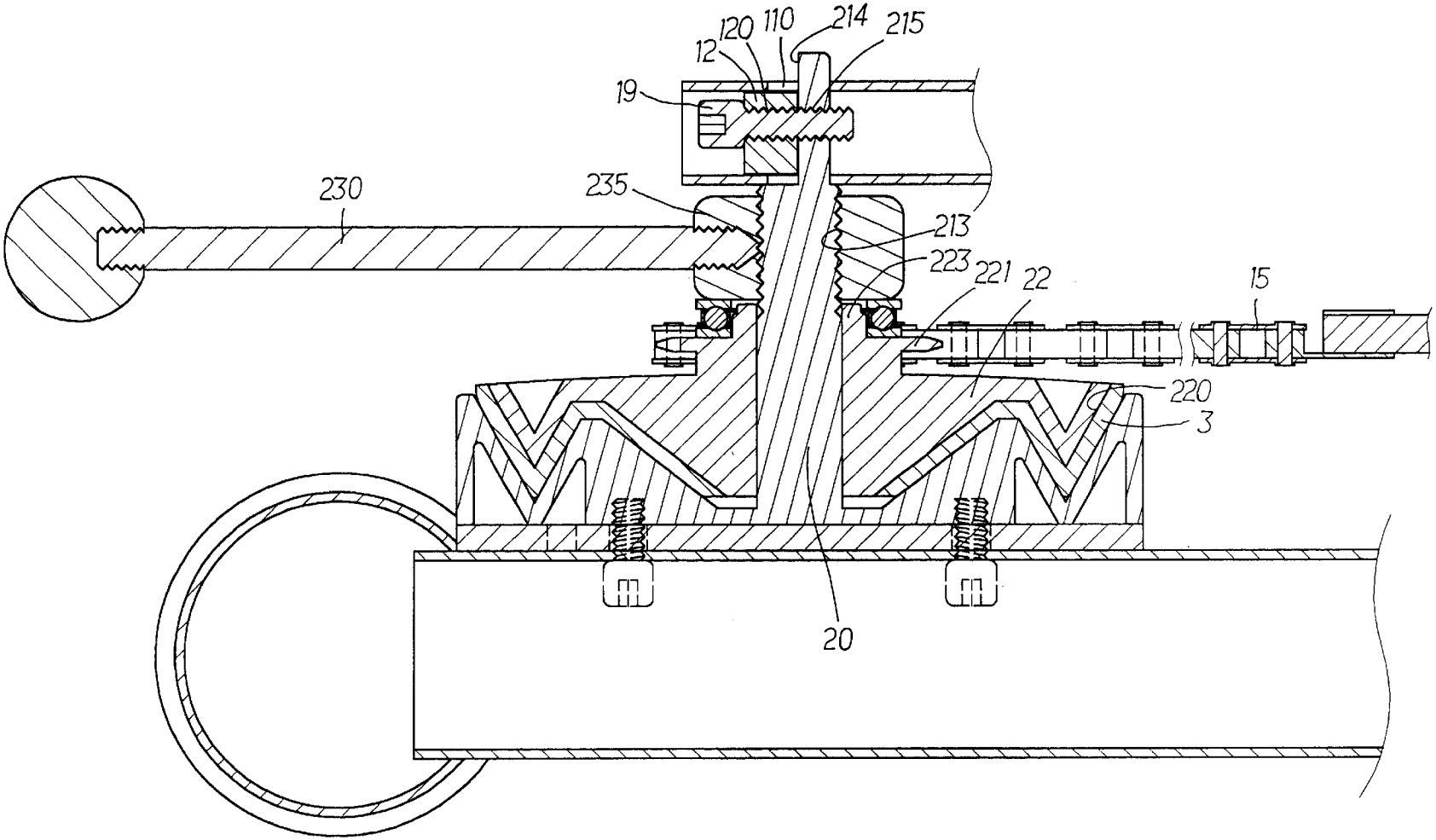
FIG. 8 is a cross sectional view to show the shaft is connected to the base member as a one-piece member.

FIG. 8 shows that the shaft 20 extends from the frame 2 directly without using bolt to connected the shaft 20 and the board 10 as shown in FIG. 3.

While we have shown and described various embodiments in accordance with the present invention, it should be clear to those skilled in the art that further embodiments may be made without departing from the scope of the present invention.

What is claimed is:

1. A damping assembly for an exercising device comprising:

a shaft, said shaft extending through a base member which has a first V-shaped annular surface;

a rotatable member movably mounted to said shaft and having a second V-shaped annular surface which protrudes from an underside of the rotatable member and is engaged with said first annular surface of said base member with a friction member clamped between said first annular surface and said second annular surface, a driving member connected to said rotatable member and a power transferring member reeving said driving member, and an adjustable member movably mounted to said shaft and a lever extending from said adjustable member, a bearing mounted to said shaft and located between said adjustable member and said rotatable member.

2. The assembly as claimed in claim 1, wherein said shaft has a threaded section and said adjustable member is engaged with said threaded section.

* * * * *